US008547252B2

(12) United States Patent
Germanetti et al.

(10) Patent No.: US 8,547,252 B2
(45) Date of Patent: Oct. 1, 2013

(54) ADAPTING SELECTIVE TERRAIN WARNINGS AS A FUNCTION OF THE INSTANTANEOUS MANEUVERABILITY OF A ROTORCRAFT

(75) Inventors: Serge Germanetti, Marseilles (FR); Alain Ducollet, Aix en Provence (FR)

(73) Assignee: Eurocopter, Marignane Cedex (FR)

( * ) Notice: Subject to any disclaimer, the term of this patent is extended or adjusted under 35 U.S.C. 154(b) by 316 days.

(21) Appl. No.: 12/529,105

(22) PCT Filed: Jun. 22, 2009

(86) PCT No.: PCT/FR2009/000759
§ 371 (c)(1),
(2), (4) Date: Jun. 7, 2011

(87) PCT Pub. No.: WO2010/007235
PCT Pub. Date: Jan. 21, 2010

(65) Prior Publication Data

US 2011/0234425 A1 Sep. 29, 2011

(30) Foreign Application Priority Data

Jun. 24, 2008 (FR) ..... 08 03537

(51) Int. Cl.
*G08B 21/00* (2006.01)

(52) U.S. Cl.
USPC ..... 340/945; 340/961; 340/970; 340/946; 701/301; 701/120

(58) Field of Classification Search
USPC ..... 340/945, 961, 970, 946; 701/301, 701/120, 5
See application file for complete search history.

(56) References Cited

U.S. PATENT DOCUMENTS

| | | | | |
|---|---|---|---|---|
| 3,245,076 | A | 4/1966 | Le Tilly et al. | |
| 3,396,391 | A | 8/1968 | Anderson et al. | |
| 5,555,175 | A | 9/1996 | D'orso | |
| 5,886,649 | A | 3/1999 | Francois | |
| 5,908,485 | A | 6/1999 | Germanetti | |
| 5,915,273 | A | 6/1999 | Germanetti | |
| 5,986,580 | A | 11/1999 | Permanne | |
| 6,195,598 | B1 | 2/2001 | Bosqui et al. | |
| 6,347,263 | B1 | 2/2002 | Johnson et al. | |
| 6,380,870 | B1 | 4/2002 | Conner et al. | |
| 6,445,310 | B1 * | 9/2002 | Bateman et al. | 340/970 |
| 6,510,388 | B1 * | 1/2003 | Sporrong et al. | 701/301 |
| 6,583,733 | B2 | 6/2003 | Ishihara et al. | |

(Continued)

FOREIGN PATENT DOCUMENTS

| | | | |
|---|---|---|---|
| EP | 0750238 | A1 | 12/1996 |
| FR | 1374954 | A | 10/1964 |

(Continued)

*Primary Examiner* — Hoi Lau
(74) *Attorney, Agent, or Firm* — Brooks Kushman P.C.

(57) ABSTRACT

A method of generating a terrain avoidance warning for a rotary wing aircraft including generating an avoidance trajectory including a proximal segment representative of a transfer time and an avoidance curve including at least one distal segment of a conic section curve following on from the proximal segment, wherein the proximal segment extends in continuation from a predicted trajectory over a distance representing an applicable reaction time, the applicable reaction time being minimized as a function of a route sheet for the aircraft, and wherein the generating includes calculating the at least one distal segment as a function of an instantaneous maneuverability of the aircraft.

11 Claims, 2 Drawing Sheets

(56) References Cited

U.S. PATENT DOCUMENTS

| | | | | |
|---|---|---|---|---|
| 6,820,006 | B2 * | 11/2004 | Patera | 701/301 |
| 6,873,903 | B2 * | 3/2005 | Baiada et al. | 701/120 |
| 7,064,680 | B2 | 6/2006 | Reynolds et al. | |
| 7,711,484 | B2 * | 5/2010 | Hammarlund et al. | 701/301 |
| 8,355,861 | B2 * | 1/2013 | Petrini | 701/301 |
| 2001/0044679 | A1 | 11/2001 | Permanne | |
| 2007/0055418 | A1 | 3/2007 | Pire et al. | |
| 2008/0125931 | A1 | 5/2008 | Gaulmin et al. | |
| 2008/0275597 | A1 | 11/2008 | Gaulmin et al. | |
| 2011/0234425 | A1 * | 9/2011 | Germanetti et al. | 340/945 |

FOREIGN PATENT DOCUMENTS

| | | | |
|---|---|---|---|
| FR | 2712251 | A1 | 5/1995 |
| FR | 2749545 | A1 | 12/1997 |
| FR | 2749546 | A1 | 12/1997 |
| FR | 2755945 | A1 | 5/1998 |
| FR | 2756256 | A1 | 5/1998 |
| FR | 2772718 | A1 | 6/1999 |
| FR | 2809082 | A1 | 11/2001 |
| FR | 2813963 | A1 | 3/2002 |
| FR | 2886439 | A1 | 12/2006 |
| FR | 2902407 | A1 | 12/2007 |
| FR | 2902408 | A1 | 12/2007 |

* cited by examiner

ADAPTING SELECTIVE TERRAIN WARNINGS AS A FUNCTION OF THE INSTANTANEOUS MANEUVERABILITY OF A ROTORCRAFT

This is a U.S. National Phase Application under 35 U.S.C. §171 of PCT/FR2009/000759, filed on Jun. 22, 2009, which claims priority to French Application No. FR 08 03537, filed on Jun. 24, 2008.

The present invention relates to the general technical field of pilot's associate systems for rotary wing aircraft, and in particular to automatic warnings for avoiding terrain.

BACKGROUND

To clarify the description, existing technologies and the technical problems they encounter are initially described in general terms. After that, mention is made of various documents that illustrate those technologies. In the above-mentioned technical field, the invention relates to so-called "on-board" pilot's associate systems, i.e. systems that are located at least in part on board manned aircraft, such as helicopters or rotary wing convertible aircraft.

The invention also relates to so-called "remote" assistance. Under such circumstances, it applies to rotary wing drones, i.e. to unmanned rotorcraft. Thus, assistance in accordance with the invention may be given to some one other than a pilot since there is no-one on board the aircraft. Under such circumstances, it is given to a human operator controlling said drone remotely. More specifically, the invention relates to pilot's associate systems that provide terrain avoidance warning, known by the acronym TAWS for "Terrain Avoidance Warning System". Such TAWSs need to make it possible to indicate dangerous obstacles situated ahead on the predicted trajectory of the aircraft, in a danger zone at a given instant, when setting closer.

In other words, such a system serves to produce warnings automatically as a function of a map whenever an obstacle in a danger zone in front of the aircraft interferes with the trajectory predicted for that aircraft at a given instant. Given the known coordinates of the instantaneous position of the aircraft, and also its flight plan and a map of the terrain it is overflying, a warning is issued whenever an obstacle interferes with the predicted avoidance trajectory, and takes a risk of making avoidance impossible.

When to trigger a warning is conventionally determined as a function of an avoidance trajectory considered as being possible for the aircraft, its initially predicted trajectory, and its instantaneous speed. In practice, it has been found that terrain avoidance warning systems, or other systems considered as Ground Proximity Warning Systems (GPWS), of the kind designed for airplanes are not satisfactory for rotary wing aircraft.

For example, patent EP 0 750 238, which has lapsed for lack of novelty, describes such a system for avoiding ground collision. That system is said to be adaptive. Although that system appears to be dedicated in general to aircraft of any type, it is appropriate only for airplanes. In particular, the system is not designed for a rotary wing aircraft or a helicopter. In addition, that document does not describe a conic section curve, nor even a proper conic section curve such as a parabola, an ellipse, or a hyperbola. That document does mention logic for updating data that incorporates parameters specific to the aircraft, and also a notion of "maneuvering capability".

However the teaching of document EP 0 750 238 does not enable the instantaneous maneuverability of a rotary wing aircraft to be taken into account. Such a calculation as a function of up-to-date data (e.g. possible vertical acceleration and/or instantaneous mass) as produced by avionics is not described by that document. In an approach that is distinct, that document provides for the input and terrain altitudes to come from active terrain sensors, an inertial navigation system, and a radar altimeter.

This is associated with specific features of the structure and the operation of such rotary wing aircraft, where the influence of such features has a greater effect on the actual potential for avoiding obstacles with rotorcraft than it does with aircraft. A rotorcraft can perform many more different types of flight, than can a fixed wing aircraft. Apart from take-off and landing, with rotorcraft, only point-to-point transport flights are comparable with the flight of airplanes, in particular civilian airplanes. Thus, a given helicopter may perform close observation flights, tactical missions, life-saving missions, interventions on accidents, etc. During such flights, the parameters that are taken into consideration and the warnings that are delivered by the terrain avoidance system designed for an airplane are inappropriate, and possibly even undesirable or even dangerous. The same applies during stages of take-off and landing, during which pilot's associate systems designed for airplanes are bound to be inappropriate.

Given this observation, recommendations specific to helicopters have recently been prepared by a major consultative authority in aviation matters, namely the Radio Technical Commission Aeronautics (RTCA) relating to terrain avoidance warning systems. Those recommendations that are specific to helicopters recommend systems that are known are as HTAWSs.

With conventional terrain warning technologies for airplanes, the anticipation distance to an obstacle that implies modifying trajectory is calculated almost exclusively as a function of the absolute value of the forward speed of the airplane. In outline, the greater the value of this speed, the longer the anticipation distance. In other words, the faster the flight, the further in front of the airplane the terrain warning system performs its surveillance. Thus, said anticipation distance is a value that is expressed in units of length (e.g. meters or kilometers). Since it is within this system that the warning system verifies whether or not there exists a terrain obstacle, this distance in front of the aircraft is also known as the danger zone.

Conventionally, the anticipation distance is usually evaluated by multiplying the instantaneous speed of the airplane by a time constant that is applicable to an entire family of airplanes. This anticipation distance involves a transfer time, i.e. the estimated reaction time of the pilot, which is the time that elapses between the warning being issued and the pilot beginning to follow an avoidance trajectory.

Nevertheless, no other parameter concerning the flight (e.g. tactical, transfer, life-saving, etc.) is taken into account, so it happens all too often in practice that warnings are triggered in untimely manner or too frequently. This hinders the pilot rather than helping. As a result, to mitigate this hindrance, it happens that the pilot switches off the operation of the pilot associate system completely. This is particularly frequent when a terrain warning system designed for an airplane is adapted to a rotorcraft.

With such systems, the calculated avoidance trajectory also takes the form of a succession between a rectilinear segment that corresponds to the transfer time, followed by a circular arc directed away from the obstacle. The trajectory is said to be in the shape of a "ski tip". In other words, most present systems rely in practice on a rectilinear transfer time based on the current speed, followed by a circularly arcuate avoidance curve of radius that corresponds to a maximum safety margin, without actually taking account of the real intrinsic capacity of the aircraft nor of its instantaneous situation. Naturally, the "ski tip" avoidance trajectory is calculated so that the pilot can act on the airplane and avoid the obstacle in the danger zone.

As mentioned above, because of the way the calculation is performed, it happens frequently in tactical flight that warnings are triggered in the absence of any real danger, or that they are erroneous or even practically permanent. From the above, it will be understood that it would be appropriate to provide a terrain warning system for a rotary wing aircraft that generates warnings only when they are of genuine use to the pilot, and at the most opportune moment possible, i.e. neither too soon nor too late. The term "reliability" is used to designate this selective exclusion of superfluous warnings.

In addition, it would be desirable for a terrain warning system for a rotary wing aircraft to provide safety that is increased, in the sense that a warning that can be avoided without recourse to the best or even maximum instantaneous capacity of the aircraft in question (i.e. its maneuverability), is inhibited or pushed back to a later moment. This enables a flight trajectory to be maintained that is as close as possible to the terrain without increasing the risks specific to the obstacles on that terrain. Such increased safety would be most desirable, e.g. during tactical military flying.

Nevertheless, it can be understood that the requirements of safety and the requirements of flying constraints are in opposition, since in practice the need is to devise a terrain warning system for a rotary wing aircraft that generates warnings specifically at the opportune moment while nevertheless remaining reliable and safe in terms of capacity for avoiding the obstacle.

SUMMARY OF THE INVENTION

An aspect of the invention is to avoid basing the origin of avoidance almost exclusively on the measured absolute value of the instantaneous speed. Nevertheless, three additional technical problems influence this approach in practice.

Firstly, logically incorporating maneuverability parameters is complex, particularly compared with airplane terrain avoidance systems that in practice incorporate only a single and absolute speed value (no physical unit).

Secondly, in order to obtain meaningful maneuverability parameters it is not desirable to require additional dedicated equipment, such as sensors, cabling, and on-board controllers. That would make the aircraft heavier in unacceptable manner.

Thirdly, since pilot's associate systems are methods implemented by computers that are programmed using computer code, it is not possible to envisage designing and writing a complete and specific algorithm or code for each model, each type, and each configuration of rotary wing aircraft.

More precisely, for logically incorporating maneuverability parameters, it can be understood that the instantaneous maneuverability of an aircraft is correlated with a large number of parameters, which it would be appropriate to sort through, to qualify, and to make mutually compatible, as well as making them compatible with being incorporated in the terrain warning system.

In particular, such parameters include a model of the aircraft in question, in the sense where a lightweight powerful and modern model of an aircraft possesses better maneuverability than another model of an aircraft that is heavier, less powerful, and older. Nevertheless, for a given model of rotary wing aircraft, maneuverability varies in non-negligible manner as a result of a variety of different situations. In particular, the maneuverability of an aircraft varies as a function of parameters such as:

- its flying environment (ambient atmospheric temperature and pressure, altitude, humidity, dust, etc.);
- its stage of flight (take-off, cruising, approach, landing, etc.);
- its initial functional state for a given flight (i.e. states concerning maintenance, age, filling level of tanks, on-board loading, on-board equipment, etc.);
- its instantaneous state (i.e. operating parameters at a given instant such as the temperatures and pressures of fluids and flows, remaining electrical charge, total mass of the aircraft, available engine power, piloting mode, i.e. visual or on instruments, etc.); and
- its route sheet (civilian or military mission, tactical or merely transport, life-saving, etc.).

It would therefore be advantageous to be able to incorporate such parameters effectively into the method of determining the avoidance trajectory, without complicating and slowing down the calculations for triggering the warning. It will be understood that this amounts to adapting in real time the way in which a terrain warning system for a rotary wing aircraft responds as a function of the actual performance of the aircraft at a given instant, and in particular as a function of its maneuverability.

In addition, it would be advantageous for the avoidance trajectory to be a better match with the terrain than a "ski tip" trajectory. For this purpose, the invention proposes an avoidance trajectory having a segment that is substantially rectilinear and proximal to the aircraft. This proximal segment represents the transfer time, without major recourse to the speed of the aircraft.

The avoidance trajectory proposed by the invention also includes a segment contiguous with the preceding segment, and that is of a curvilinear conic-section shape. The frame of reference in such an avoidance trajectory plotted has an axis that can be thought of as the abscissa associated with the speed of the rotary wing aircraft at a given instant, and which it is desired to slow down. The other axis in this frame of reference that can be thought of as the ordinate corresponds to the capacity of the aircraft for vertical acceleration. It can thus be understood that false warnings can be limited and often avoided.

However, unless it is possible to obtain these parameters without complicating the rotary wing aircraft or making it heavier, the advantages obtained by taking these parameters into account would be greatly reduced or even non-existent. This thus raises the question of obtaining parameters concerning maneuverability that are meaningful, coherent, and trustworthy, without requiring manifest additional dedicated equipment.

This dilemma is solved in unexpected manner. To summarize, the useful parameters are obtained by suitable approximations based on data that is produced by the usual avionics in modern rotary wing aircraft. In particular, these approximations are made possible by logically coupling data that is already available on board. This goes against the usual present-day prejudices.

Indeed, the invention provides for choices that are the opposite of the obvious concerning the data taken for this use, enabling it to be both meaningful and compatible with the approximations that need to be made, which is advantageous. Thus, an implementation of the invention provides in particular for:

a transfer distance in the form of a time that is minimized as a function of at least one parameter already available on board, such as the route sheet (e.g. tactical flight or cruising flight); and a proposed avoidance trajectory that is optimized, comprising at least one segment in the form of a conic section (non-circular), calculated in particular in real time as a function of up-to-date data produced by the avionics, such as the potential vertical acceleration on the basis of the collective pitch of the lift and propulsion rotor(s) and/or of the instantaneous mass of the rotary wing aircraft.

Said data produced by the avionics is produced by one or more existing or conventional avionics units, e.g. a first limitation indicator (FLI) as mentioned above. Numerous rotary wing aircraft already have avionics such as an FLI continuously calculating an available power margin that is given in the form of a collective pitch value for its so-called "main" rotor(s).

This collective pitch value is thus available on board without requiring any additional equipment. This collective pitch value corresponds to the product of the available vertical acceleration at a given instant multiplied by a coefficient that is proportional to the mass of the aircraft (either at take-off, or else as estimated at the selected instant).

Incorporating this collective pitch value that is representative of the power margin makes it possible in simple manner to obtain a terrain warning system that can be said to be "adaptive" for calculating the danger zone, the transfer distance, and the avoidance curve, with this being done without influencing the specific algorithm for this particular pilot's associate system.

Thus, in the kinds of situation with which a rotary wing aircraft is confronted, the avoidance trajectory is optimized. This avoidance trajectory approaches a horizontal tangent when little or no power margin is available. In contrast, the avoidance trajectory approaches a vertical tangent when the longitudinal speed of the aircraft is low and/or the available power is large. This situation is particularly useful during a tactical flight since it minimizes the danger zone while allowing flying to take place at low altitude over the terrain.

This incorporation of values obtained by existing avionics also makes it possible to avoid the third additional technical problem mentioned above, i.e. that of writing an algorithm that is unique, complete, and compatible with numerous models, types, and configurations of rotary wing aircraft. The parameters obtained can be considered logically merely as variables that are suitable for being injected as data into a single algorithm, i.e. an algorithm that is compatible with a broad range of rotary wing aircraft.

We now mention various documents relating to pilot's associate systems. In general, reference can be made in particular to Circular No. 0236-2005.07.29 of Transport Canada, Civil Aviation, which gives definitions and a few brief explanations about various on-board impact alarm and warning systems (TAWSs), other anticollision systems, and forward-looking terrain avoidance (FLTA) systems. On the same lines, Recommendation RTCA-309 relating to future HTAWS systems proposes functions to be provided for such helicopter-dedicated systems.

Document FR 1 374 954 proposes an automatic pilot for aircraft flights at very low altitude, in which maneuvers are limited in their effects to a determined minimum. Document FR 2 813 963 describes a visual display of ground collision avoidance information in an aircraft, and more specifically in an airplane. A control factor includes the distance to the obstacle, and also the variation of said distance and the direction of the velocity vector, whether it is climbing, horizontal, or descending. To avoid information and warning overload during stages of take-off and landing, some information is inhibited insofar as the lowest point is below a selected altitude and the proximity of the aircraft with the landing zone corresponds to a validated criterion. For this purpose, static and dynamic parameters are taken into consideration, including components of the velocity vector, and where applicable of the acceleration vector. According to that document, during the approach stage, the predicted axis may be curvilinear and the vertical plane is not necessarily flat.

Document FR 2 749 545 describes the fundamentals of a first limitation indicator (FLI) system. That system determines the available power margin on one or more engines of an aircraft as a function of flying conditions. The purpose is to enable the pilot to "withdraw" information that is pertinent for piloting. Furthermore, that document indicates that the information provided by the FLI, in addition to its display, can be used as basic information for generating a force relationship suitable for warning the pilot if approaching a limit due to physical means: stiffening of a spring or of an actuator, vibration, for example.

In addition to document FR 2 749 545, documents FR 2 749 546, FR 2 755 945, FR 2 756 256, FR 2 772 718, FR 2 809 082, FR 2 902 407, and FR 2 902 408 describe characteristics specific to FLIs, and they were all filed by the present Applicant. The teaching thereof is incorporated in the present application in order to avoid superfluous repetition.

In particular, document FR 2 756 256 describes a power margin FLI for a rotary wing aircraft, in particular a helicopter, that is designed to provide information concerning the available power margin as a function of flying conditions. On the basis of piloting parameters and limit values concerning engine utilization, a power margin indicator is generated that is expressed as a collective pitch value, in particular. Document FR 2 712 251 describes a low altitude pilot associate system. In order to determine dangerous obstacles and provide assistance in avoiding them, the position of an optimum avoidance point is calculated in particular from the velocity vector of the helicopter. A pull-up limit load factor depends in particular on the mass of the helicopter. An audible warning may be given in addition to the visual display. An angular sector search zone is limited to a distance L from the helicopter.

Document FR 2 886 439 describes a low altitude pilot's associate system for performing contour or tactical flying. To provide such assistance, an optimum curve is determined as a function of the speed of the aircraft. Document U.S. Pat. No. 3,245,076 seeks to optimize the use of the maneuvering capacity of the aircraft in an autopilot. Document U.S. Pat. No. 3,396,391 mentions having recourse to representations of acceleration, and also of load factors of an aircraft in order to calculate a flightpath. The speed of an aircraft is taken into account in order to determine a desired height above the ground.

Document U.S. Pat. No. 6,347,263 describes a terrain warning generator for an aircraft that presents a warning envelope with a lower limit formed from the smaller value from a flight direction angle and a possible climb gradient. The warning envelope has a first segment between two points, and the projected climb of the aircraft is calculated as a function of various parameters, such as the predictable pull-up, lift, drag, and the estimated weight of the aircraft.

Document U.S. Pat. No. 6,380,870 describes determining a look-ahead distance for a high speed flight, typically for an airplane. The objective is to make the flight as constant as possible by switching between a variable reaction time and a constant reaction time at high speed. This also limits interfering alerts at low speed. Document U.S. Pat. No. 6,583,733 describes a ground proximity warning system for a helicopter, the system having first and second modes of operation. These modes are selected by the pilot. A display for the pilot is shown. The system is described as a TAWS or GPWS, incorporating features specific to rotorcraft flight as compared with a fixed wing aircraft. In addition, the objective is to adapt the system to the type of flight in progress, while taking account of the instantaneous capabilities of the aircraft and limiting interfering alerts. For this purpose, information is collected from a global positioning system (GPS).

Document U.S. Pat. No. 7,064,680 describes forward-looking terrain avoidance (FLTA) for an airliner, that conventionally delivers audible alerts in the form of a warning (e.g. "terrain") and advice (e.g. "pull-up"). In addition, once the avoidance maneuver has been completed and as a function of a projection onto the horizontal of the airplane prior to completing the maneuver, an audible alert is issued comprising both a warning (e.g. "terrain"), and advice that the danger is over (e.g. "clear").

In an embodiment, the present invention provides a pilot associate system that is adaptive, safe, and reliable, by incorporating data that is compatible with useful approximations and representative of the instantaneous maneuverability of a rotary wing aircraft, such as a helicopter, a convertible aircraft, or a drone. For example, such a system proposes an HTAWS logically coupled with an FLI that implements algorithms for incorporating instantaneous maneuverability data so as to issue selective warnings that are sufficiently trustworthy and reliable, and in particular that are not overabundant.

With alerts made selective in this way, it is possible to incorporate a dedicated audible alarm while remaining effective and comfortable, i.e. not too intrusive. For example, such an audible alarm may be in the form of an explicit and contextual voice message, that can be heard by the person at the controls and that lightens attention burden, leaving that person free to concentrate on the piloting instruments to be actuated. For this purpose, various implementations of the method, of the terrain warning device, and of a rotary wing aircraft of the invention are defined by the following characteristics, in particular. The invention provides a method of generating a terrain avoidance warning for a rotary wing aircraft.

The method provides for generating an avoidance trajectory that includes a proximal segment representative of a transfer time, and an avoidance curve. Said proximal segment is extended in continuation with a predicted trajectory over a distance that represents an applicable duration that has been minimized as a function of a route sheet of the aircraft. Said avoidance curve includes at least a distal segment of conic section profile running on from the proximal segment and calculated as a function of the instantaneous maneuverability of the aircraft.

In an implementation of the method, the proximal segment is rectilinear. As used herein, rectilinear means substantially rectilinear. In an implementation of the method, the minimized applicable duration is a function of a route sheet and of a parameter representing the model of the aircraft. In an implementation of the method, the applicable duration is minimized as a function of a route sheet, and is then divided by at least one limiting ratio representing a flight parameter of the aircraft. In an implementation, the conic section curve is of the proper type, such as a parabola, an ellipse, or a hyperbola. In an implementation of the invention, the conic section curve is calculated in real time, as a function of up-to-date data produced by avionics, including a value for possible vertical acceleration and/or a value for the instantaneous mass of the rotary wing aircraft.

The invention also provides a terrain warning device. The device is logically coupled with a maneuverability indicator system, e.g. an FLI. In an embodiment, the device is located at least in part on board, and comprises avionics with a flight computer suitable for executing code that enables the above method to be implemented. The invention also provides a rotary wing aircraft, whether a helicopter, or a convertible aircraft, or a rotary wing drone. In an embodiment, the aircraft is suitable for implementing the above-mentioned method and/or includes a terrain warning device as mentioned above. In an embodiment, the aircraft possesses an audible alarm designed to be triggered selectively by the terrain warning.

BRIEF DESCRIPTION OF THE DRAWINGS

The invention is described below with reference to non-limiting implementations as shown in the accompanying drawings, in which.

In all of the FIGS. 1 to 5, elements that are similar are given the same reference numbers.

DETAILED DESCRIPTION

Figure 1:
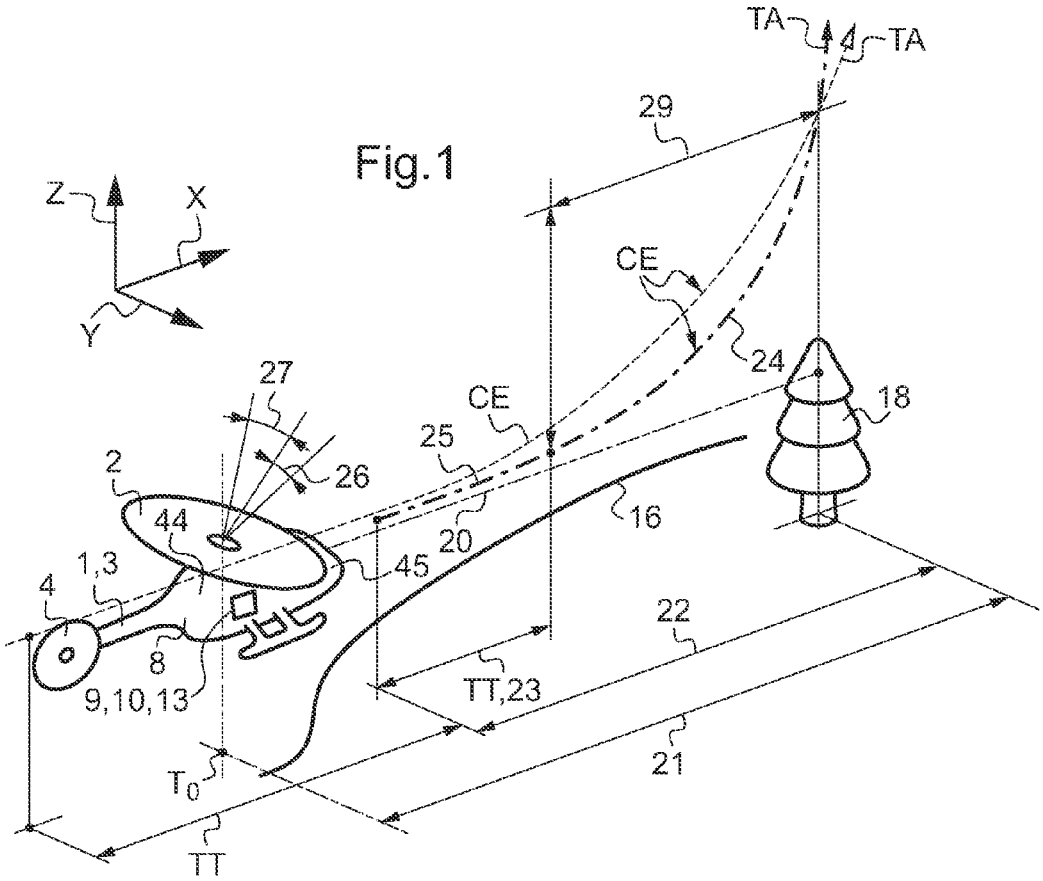
FIG. 1 is a fragmentary diagrammatic perspective view in longitudinal elevation showing an implementation involving a rotary wing aircraft, here a helicopter, fitted with means suitable for implementing the terrain warning adaptation in accordance with the invention, in particular as a function of the maneuverability of the aircraft; for comparative purposes, this figure shows: the transfer times (TT) and the avoidance curves (CE) in accordance with prior art techniques in the upper portion (dashed lines) and in accordance with the invention in the bottom portion (chain-dotted lines)

The figures show three mutually orthogonal directions X, Y, and Z forming a three-dimensional frame of reference X, Y, Z. When necessary, this frame of reference X, Y, Z is orthonormal, e.g. to simplify calculations.

A "longitudinal" direction X corresponds to the lengths or main dimensions of the structures described. Thus, the longitudinal direction X defines the main forward advance direction of the aircraft described, and the tangent to their instantaneous trajectory at their center of gravity.

Another direction Y is said to be "transverse", and corresponds to lateral trajectories or coordinates of the structures described; these longitudinal and transverse directions X and Y are sometimes said to be "horizontal", for simplification purposes.

A third direction Z is said to be in "elevation" and corresponds to height and altitude directions for the structures described: the terms up/down or pull-up/nose-down refer thereto; by simplification this direction Z is sometimes said to be "vertical".

For example, the term "pull-up" designates an action on the trajectory, causing its tangents to move upwards along said elevation direction, whereas the term "nose-down" indicates the trajectory being moved downwards in said elevation direction. Together, the directions X and Y define an X, Y plane that is said to be the "main" plane within which the lift polygon of an aircraft being described is inscribed.

In the figures, reference 1 is a general reference designating a rotary wing aircraft or "rotorcraft", that possesses at least one lift and propulsion rotor 2. In other words, the aircraft 1 of the invention are capable of taking off vertically and of hovering. Certain aircraft 1 in accordance with the invention possess a plurality of lift and propulsion rotors 2, e.g. two rotors 2 in tandem or superposed. An engine unit 44 is naturally provided on each aircraft 1.

In FIG. 1, the aircraft 1 is a rotorcraft, and more particularly a helicopter 3 in accordance with the invention, having a single lift and propulsion rotor 2, together with an antitorque rotor 4 at its tail.

Figure 2:
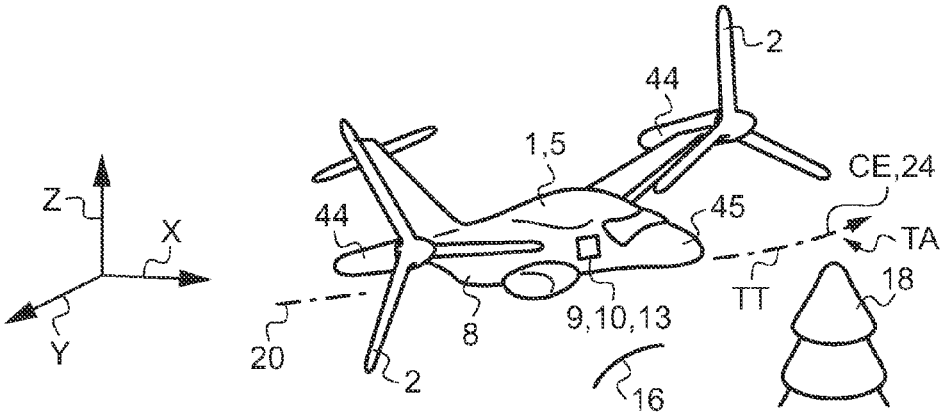
FIG. 2 is a fragmentary diagrammatic perspective view in longitudinal elevation showing an implementation involving a rotary wing aircraft, here a convertible aircraft, fitted with means suitable for implementing the terrain warning adaptation in accordance with the invention.

In FIG. 2, the aircraft 1 is a convertible aircraft 5 in accordance with the invention that is provided with two lift and propulsion rotors 2, that can be tilted.

Figure 3:
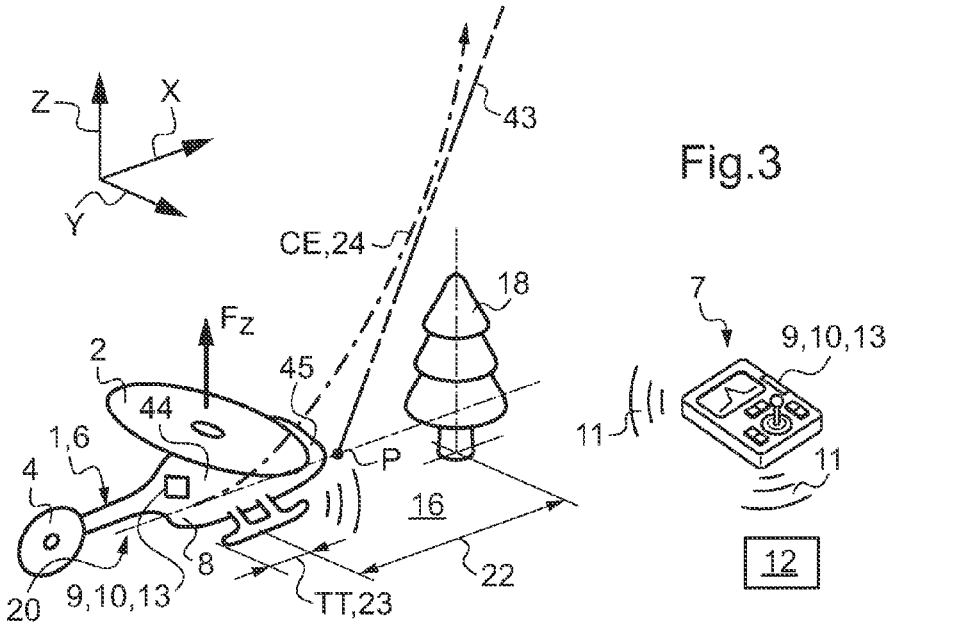
FIG. 3 is a fragmentary diagrammatic perspective view in longitudinal elevation showing an implementation involving a rotary wing aircraft, here a drone, together with its remote radio control station that is fitted with means suitable for implementing the terrain warning adaptation in accordance with the invention.

FIG. 3 shows an unmanned rotary wing aircraft 1, here a drone 6, together with its remote radio control station 7, both in accordance with the invention. The drone 6 possesses a single lift and propulsion rotor 2. Certain drones 6 of the invention possess at least two rotors 2, sometimes superposed and incorporated within a fuselage 8, e.g. a saucer-shaped fuselage.

Figure 4:
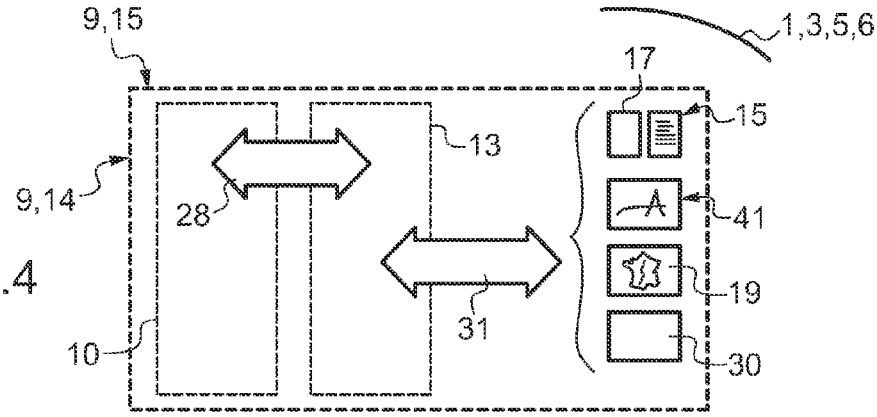
FIG. 4 is a fragmentary diagrammatic view of an embodiment of a terrain warning device in accordance with the invention for a rotary wing aircraft.

All of the aircraft 1, 3, 5, and 6 in accordance with the invention possess at least one avionics unit 9, such as that shown diagrammatically in dashed lines in FIG. 4. Likewise, each avionics unit 9 possesses at least one pilot's associate system such as the terrain warning devices 10 shown in FIGS. 1 and 5. These devices 10 are impact warning and alarm systems, typically but not exclusively TAWSs. Each impact warning and alarm device 10 serves to produce an avoidance trajectory referenced TA in FIGS. 1 to 3 and to supply it to the person controlling the aircraft 1 (pilot or remote operator). In the examples, each aircraft 1 possesses an alarm 45 suitable for being triggered by the device 10. The alarm 45 may deliver a sound and/or a display.

The avoidance trajectory TA is made up of two contiguous segments, one being a proximal segment close to the aircraft 1 that is substantially rectilinear and that, when projected on a transverse and longitudinal plane (X, Y) represents the transfer time (TT). The other segment of the avoidance trajectory TA describes at least one portion that is curved at least in part and/or transiently, and it is remote from the aircraft 1. This is referred to as the distal or curvilinear segment.

In FIG. 1, the curvilinear segment extends continuously from the proximal segment, and when projected on said transverse and longitudinal plane (X, Y) it represents the travel time of the aircraft 1 for its avoidance curve (CE).

According to the invention, the distal segment includes, or is indeed constituted entirely by, a curve constituting a conic section, whereas in so-called ski-tip trajectories the segment is a circular arc. At this stage, it is appropriate to recall certain details about the concept of a conic section. Conic sections form a family of curves that result from the intersection of a plane and a circular cone. Conic sections are said to be proper when the intersecting plane is not perpendicular to the axis of the cone and does not pass through the apex thereof. It is shown below that the curvilinear segments of the avoidance trajectory TA of the invention are frequently of the proper conic section type.

Three types of proper conic section are distinguished depending on the angle of inclination between the intersection plane and the axis of the cone: ellipses, parabolas, and hyperbolas. All of these proper conic sections may give rise to the trace of the avoidance curve CE of the trajectory TA of the invention. If both angles are equal, then the conic section is a parabola. A single-focus definition of conic sections implies a focus and a directrix.

More commonly, a conic section is expressed as an algebraic equation of second order, in affine analytical geometry, assuming conic sections to be plane curves, i.e. curves having Cartesian coordinates x and y as points along the X and Y axes respectively, that constitute solutions to a second degree polynomial equation of the following form:

$$Ax^2+Bxy+Cy^2+Dx+Ey+F=0$$

where A, B, C, D, E, and F are the coefficients of the conic section.

The frame of reference used in the examples is the frame made up of the three orthogonal directions X, Y, Z in which x, y, and z are the variables of the points of the curve on respective ones of said axes or directions X, Y, and Z. If E is non-zero, then a shift in translation along the X axis of the variables y can make F zero (where F is the focus of the parabola). Then, by writing:

$$p=-A/E$$

it is possible to obtain a reduced Cartesian equation for a parabola that is written:

$$y=px^2$$

If D is non-zero, then the reduced equation of a parabola is written:

$$x=qy^2$$

With parabolas, conic sections are obtained by the intersection between a circular cone and a plane, where said parabola occurs when the plane is parallel to one of the generator lines of said cone. It is then considered that the parabola is given by its focus F and its directrix D. A projection of is then obtained by projecting the focus F orthogonally onto the directrix D. One of the parameters of a parabola is written "p", and it corresponds to the distance OF, forming a segment [FO]. This segment [FO] presents a middle S. Then in the X, Y, Z, frame of reference (assumed to be orthonormal), where Z is along the same axis and in the same direction as the vector $\overrightarrow{OF}$, the equation for the parabola is written in the form: $y=x^2/2p$. With this geometrical terminology specified, we return to the invention.

In general, the terrain warning device 10 is at least in part on board, in the sense that it is essentially situated on board the aircraft 1. Nevertheless, in certain embodiments, components of such a device 10 of the invention may be on board while others are remote from the aircraft 1. For example, in the particular circumstance of a drone 6 as shown in FIG. 3, the warning device 10 is physically located in part on board the aircraft 1, and is incorporated in part in its radio control station 7, or else it is even more remote, being accessed via a data transfer connection 11 to a dedicated calculation center 12. This connection 11 is a telecommunications connection in FIG. 3.

In addition to the warning device 10, the avionics unit 9 includes various other functions such as providing assistance in navigation, an autopilot, a ground proximity warning, a forward-looking terrain avoidance function, a premature descent algorithm, an on-board anticollision system, a traffic warning and collision avoidance system, a global positioning system, etc. It should be observed at this point that the avionics unit 9 and its subassemblies such as the device 10 operate iteratively and in real time. In the invention, the avionics unit 9 includes an indicator system 13 referred to herein as a maneuverability indicator system. This system likewise operates iteratively and in real time.

Such a maneuverability indicator system 13 is capable of producing and/or delivering a variety of meaningful parameters and data in context, from which it is possible by means of the characteristics of the invention to provide maneuverability indicators for the aircraft 1. Below, in order to clarify the explanation without limiting its scope, consideration is given to a single "main" rotor 2, it being understood that the person skilled in the art is capable of implementing the invention on the basis of this description for the various circumstances in which an aircraft 1 possesses a plurality of lift and propulsion rotors 2.

The system 13 then takes all of the rotors 2 of the aircraft 1 into consideration and thus delivers data representative of the overall situation of the aircraft. In the examples given, the maneuverability indicator system 13 includes a first limitation indicator FLI. Naturally, other systems 13 are comparable with the invention, in particular when they provide the necessary data, as specified in greater detail below.

In one embodiment, the maneuverability indicator system 13 reproduces the teaching of document FR 2 756 256 so as to provide available power margin information as a function of conditions of flight. On the basis of piloting parameters and engine utilization limit values, a power margin indicator is devised that is expressed in particular as a collective pitch value. As mentioned above, the FLI system 13 continuously calculates an available power margin in the form of a collective pitch value for the "main" rotor 2 of the aircraft 1, regardless of whether the aircraft is a helicopter 3, a convertible 5, or a drone 6. This collective pitch value is thus available for the avionics unit 9, and in particular for the pilot's associate device 10.

Figure 5:
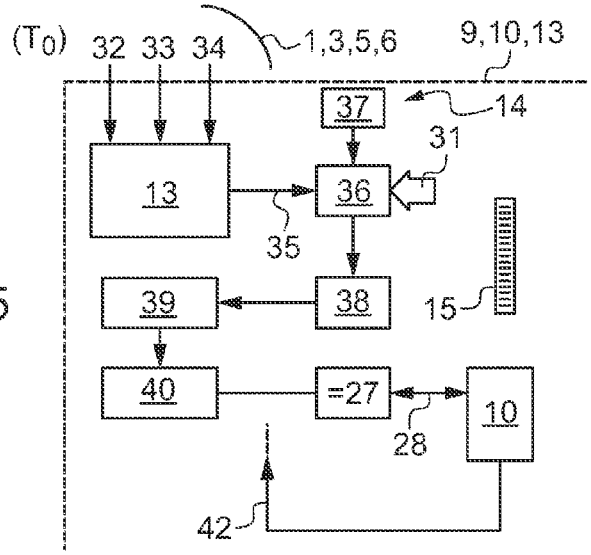
FIG. 5 is a logic graph showing the main steps and stages in accordance with the invention in an implementation of a terrain warning method for a rotary wing aircraft, in particular as a function of the maneuverability of the aircraft.

This available collective pitch value corresponds to the product of the vertical acceleration, written herein as "Gz", that can be achieved at a given instant multiplied by a coefficient K that is proportional to the mass of the aircraft 1. The coefficient K is initialized on take-off, and it is estimated in real time at the instant in question. Insofar as this value Gz can be assumed to be a constant while calculating the conic section 24 for the avoidance curve CE, then the curve has the shape of a parabola. It should be observed that the unit 9, like the device 10 and the system 13 includes at least one computer 14 that is programmed as a function of computer code 15 (FIGS. 4 and 5).

Specifically in the device 10 of the invention, the complete algorithm or program code 15 is designed and written so as to be compatible, without significant modification, with as great a possible a number of models of aircraft 1. Only the data or parameters injected into the code 15 then serve to adapt the invention to each type and/or each configuration of rotary wing aircraft 1.

An example of a terrain warning function that takes account specifically of the maneuvering margin of the aircraft 1 is described below with reference to FIGS. 1, 4, and 5. In FIG. 1, there can be seen terrain 16 over which the aircraft 1 is proceeding to fly. In the aircraft 1, and more particularly in its unit 9, there is recorded a map 17 that represents this terrain 16 over which it is flying.

However, some of the recordings that are useful to the unit 9 may be located remote from the aircraft 1, particularly when it is a drone 6. On this terrain 16, there is an obstacle 18. The aircraft is following a flight plan 19 recorded in the unit 9, in which there is defined a predicted trajectory 20 for the flight, represented in FIG. 1 by a straight line for simplification purposes.

It can be seen that the obstacle 18 lies on the predicted trajectory 20, at a certain distance 21 ahead of the aircraft 1, such that there is a risk of collision. As explained above, the invention seeks to issue a warning at the most appropriate opportunity that is representative of this risk, while still allowing the aircraft 1 to fly as close as possible to the terrain 16.

FIG. 1 also shows an anticipation distance 22, i.e. the distance between the obstacle 18 and the position of the aircraft 1 at the moment $T_0$ when the warning was issued. It is recalled that this distance 22 is usually calculated as a function of the flying speed of the aircraft 1. The warning is issued only if the obstacle 18 lies on the predicted trajectory 20 of the aircraft 1, and within the distance 22 that is also referred to as the danger zone. In FIG. 1, the conventional avoidance trajectory TA drawn as a dashed line corresponds to the transfer time TT spliced onto a circular arc CE and shows clearly the drawbacks of technologies that are based on flying speed (often the flying speed multiplied by a given transfer time, which time is usually constant).

To summarize, the anticipation distance is excessive compared with the actual resources of the aircraft 1, and furthermore it avoids the obstacle 18 by overflying it at a height that is considerably greater than the height genuinely required to satisfy flight procedure, the real context, and safety. In order to improve terrain warning systems, in particular to reduce the anticipation distance 22 while also eliminating pointless warnings and enabling obstacles to be avoided as closely as possible, the invention acts in particular to take account of the maneuverability margin of the aircraft 1. As explained above, in the invention, the value of the flying speed is not preponderant in determining the avoidance trajectory TA, since in order to form this trajectory TA, the following are taken into consideration:

- a transfer time TT that is limited like the reaction time 23 in FIG. 1, e.g. of the order of 0.5 s to 2 s, this corresponding to a substantially rectilinear proximal segment 25; and
- running on therefrom, an avoidance curve CE forming the distal segment 24 and comprising a conic section curve, e.g. a parabolic curve, that is a function of the instantaneous maneuverability of the aircraft 1.

Thus, for an aircraft 1 that is highly maneuverable and/or that is in a difficult flight context, the avoidance trajectory, TA=segment 25+segment 24, is short, i.e. is inscribed in an anticipation distance 22 that is shorter in the longitudinal direction X than the distance 22 that would be calculated for an aircraft 1 that is less maneuverable and/or that is in a flying context that is less difficult. Consequently, in the above context, the terrain warning is issued by the device 10 at a shorter distance 22 from the obstacle 18 in the first configuration than in the second.

As mentioned, the reaction time 23 to which the proximal segment 25 corresponds is evaluated in particular as a function of the route sheet 41 for the flight being performed by the aircraft 1. Thus, if the flight is a tactical military mission operated by an aircraft 1 that is modern, lightweight, and powerful, the reaction time 23 may be of the order of 0.5 s to 1 s. If the flight is mere transport operated by an aircraft 1 that is heavy and basic, then the reaction time 23 may be of the order of 1 s to 2 s, for example.

Naturally, the value finally given to this reaction time 23 may initially be evaluated as a function specifically of the flight sheet 41, and then adjusted as a function of context values, such as variable parameters representative of the state of the aircraft 1 that is about to start avoidance, e.g. obtained in real time. In one example, the transfer time TT/23 that defines the proximal segment 25 is calculated by the device 10, as follows:

Firstly, an initially applicable duration or time value, lying in the range approximately 0.5 s to 2 s, is determined as a function of the model of the aircraft 1.

Thereafter, limitation weighting is performed on this initially applicable duration, as a function of the route sheet 41. By way of example, this weighting may be a first indication, such as dividing by a first limiting ratio.

In one implementation, this first ratio is about 1 for a cruising flight, and about 1.1 to 2 for a tactical military flight. This provides a transfer time TT/23 that is taken into account by the device 10 when determining the terrain warning. In another implementation, an adjustment is also applied so as to lead to a transfer time TT/23 that is reduced twice over. Thus, the time TT provided by dividing the initially applicable duration by the first ratio is again limited by division, but this time as a function of a parameter that represents an acceptable increase in risk, here the experience of the person controlling the aircraft 1.

One implementation provides for the second limitation parameter to represent the level of piloting expertise. If the pilot or the operator on the ground is experienced, then this second limitation parameter is about 1.1 to 1.3, e.g. 1.25. If the pilot or the operator is normally qualified, then this second limitation parameter is of the order of 1. Another implementation provides for the second limitation parameter to represent the priority factor of the mission. If the mission is of high priority, and includes intrinsic risk, as in combat, then the second limitation parameter is about 1.1 to 1.2, e.g. 1.15. If the mission is of more ordinary importance, then this second limitation parameter is about 1.

It should be observed that in the invention, the proximal segment 25 need not necessarily be rectilinear. In certain configurations it is obtained by continuing the predicted trajectory 20, whether it is straight or curvilinear, for the time TT that is obtained and written 23. Thus, with the invention, it is possible to further improve the safety and reliability of the avoidance warning by taking account at a given moment of data representative of the genuine structural state of the aircraft 1, i.e. enabling the distances 21 and 22 to be further shortened, if that is possible.

For a given aircraft 1, particularly depending on instantaneous operating conditions (including the temperatures and pressures that have an influence on the engine 44), and depending on its instantaneous mass, and given an identical route sheet 41, facing a similar obstacle 18, may possess avionics resources that are quite different in terms in particular of response time and available acceleration margin Gz. In other words, it is desired to take account of the real performance of the aircraft 1 at a given moment so as to avoid any false warnings and minimize departures from the predicted trajectory 20 as much as possible.

To this end, and in accordance with the invention, the conic section segment 24 defines, along the abscissa in the longitudinal direction X, at least a portion of the avoidance curve CE as a function of a velocity value that the aircraft 1 can reach at the end of a transfer time 23 (e.g. an acceptable slowing down), and on the ordinate as a function of the vertical acceleration capacity Gz of said aircraft 1 at the end of the transfer time 23. Under such circumstances, the conic section curve 24 is relatively close to the predicted trajectory 25 and thus to the "horizontal" longitudinal direction X, if the maneuverability of the aircraft 1 is low. This necessarily requires the anticipation distance 22 to be lengthened.

Conversely, the conic section curve 24 is capable, momentarily, of diverging considerably from the predicted trajectory 25 and thus of going towards the elevation direction Z (referred to as "vertical") in an upward direction, if the aircraft 1 has high maneuverability. This necessarily leads to a shortening of the anticipation distance 22. This ability of the aircraft 1 to depart from the predicted trajectory 25 momentarily in a pull-up configuration gives rise in meaningful manner to an increase in the value for the collective pitch angle 26 of the lift and propulsion rotor 2. In particular, this increase in the value of the angle 26 is referred to as the collective pitch margin 27. This is shown diagrammatically in FIG. 1. Such maneuverability parameters, i.e. the collective pitch 26 and the collective pitch margin 27 are obtained advantageously by a preferred implementation of the invention.

In order to obtain the available margin for vertical acceleration Gz, the pilot's associate device 10, e.g. a TAWS, is logically coupled with the avoidance warning system 13, e.g. an FLI. This is represented by arrow 28 in FIG. 4 and requires little or no additional cabling, and the additional processing means that need to be provided under such circumstances are usually limited to the programming code 15 of the computer 14. In the equations for calculating the avoidance curve 24, this available margin for vertical acceleration Gz is represented by ΔGz (delta Gz). It turns out that from the collective pitch 26, ΔGz defines an increase 27 in the pitch angle for the blades of the rotor 2. This represents a value that, although approximate, is acceptable such as the angle 27 corresponding to:

$$\Delta Gz=(K\times Gz)$$

where a coefficient K represents the instantaneous mass of the aircraft 1 at the time the calculation is performed, i.e. at the instant $T_0$. As a result, with the coefficient K being calculated as a function of the mass of the aircraft 1, and since the margin 27 or ΔGz that is available for vertical acceleration Gz represents the force Fz (see FIG. 3) in the elevation direction Z that the rotor 2 is capable of developing, it is possible to obtain a meaningful value for vertical acceleration Gz on the basis of parameters introduced by the system 13 to the device 10. On the basis of this instantaneous value for Gz, this value is introduced into a conic function 24 so as to provide the avoidance curve CE of the invention.

In an implementation, the instantaneous value of Gz is introduced into a conic function 24 and provides a raw avoidance curve CE that is subsequently adjusted as a function of additional context data or maneuverability parameters. Observe that the conic function 24 of the avoidance curve CE is thus a function of the power margin, or at least of the vertical acceleration Gz of the aircraft 1, at the instant $T_0$. From the instant $T_0$, the invention deduces the proximal transfer segment 25 and the conic function 24 for the avoidance curve CE. The sum of the projections 23 of the segment 25 plus a projection 29 of the conic avoidance curve 24 on the longitudinal axis X is clearly shorter than the sum of the distances TT and 21 as obtained with conventional techniques.

In implementations of the invention, various parameters as listed below and as designated 30 in FIG. 4 are taken into account and incorporated in evaluating the avoidance trajectory TA specific to the invention, since they influence the maneuverability of the aircraft 1. These parameters are as follows:

- the flying environment (ambient atmospheric treatment and pressure, altitude, atmospheric conditions, visibility, etc.);
- the stage of flight (take-off, cruising, approach, landing, etc.);
- the initial functional state of the aircraft for a given flight (states of maintenance, aging, tank filling level, on-board load, on-board equipment, etc.);
- its instantaneous state (operating parameters at a given instant, such as the temperatures and pressures of fluids and flows, the total mass of the aircraft, the available engine power, piloting mode, i.e. visually or on instruments, etc.); and
- its route sheet 41 (civilian or military mission, tactical or merely transport, lifesaving, etc.).

Integration of the parameters 41, 17, 19, and 30 is represented by arrow 31 in FIG. 4. From a logical point of view this amounts to coupling the pilot's associate device 10, e.g. a TAWS, with the maneuverability indicator warning system 13. With reference to FIG. 5, an implementation of the method of the invention is shown diagrammatically and summarized below.

In this example, instantaneous parameters such as the temperature 32 of the engine 44 of the aircraft 1, the pressure 33 at the engine 44, and also the torque 34 delivered to the rotor 2, are injected logically into the maneuverability indicator system 13, e.g. an FLI. If necessary, this method is iterative and the injection of parameters 32 to 34 is the step at the beginning of a logic loop at time $T_0$. On the basis of these parameters 32, 33, and 34, in particular, the maneuverability indicator system 13 calculates an instantaneous value for the available power margin, referenced 35. As mentioned above, this is performed in accordance with the invention.

In a step 36 (represented by an incorporation arrangement also given reference 36), so-called "static" parameters 37 are incorporated, and in particular parameters 37 that are meaningfully representative of the model of the aircraft 1 (stored within the unit 9, e.g. via the computer 14 or a connection 11).

It is also in this step 36 that other meaningful parameters, such as the flight plan 19, are incorporated, as represented by arrow 31. The step 36 also serves to produce the transfer time TT=23, and thus the proximal segment 25. At a later step 38, a collective pitch margin 27 is deduced that is reachable by the aircraft 1 at instant $T_0$. As described above, it is possible to make a satisfactory approximation and assume that the vertical upward force Fz that can be developed by the rotor 2 is represented by, or even equal to, K times Gz, which is a function of the collective pitch margin 27. This corresponds to the equation:

$$Fz=(K\cdot Gz)$$

Thereafter, in a step 39, the proximal and curvilinear segments 25 and 24 of the avoidance curve CE, i.e. of the avoidance trajectory TA are defined (which trajectory may possibly be adjusted subsequently). This trajectory TA is generated so as to correspond to the following equation:

$$TA=(TT)+\tfrac{1}{2}\,Gz(TT)^2$$

where the time TT is equal to the calculated duration 23.

At a subsequently step 40, the results of this equation are estimated on the assumption of a transient avoidance curve (applied only as a transient calculation value) that is circular, in order to deduce a value R that defines a radius for this transient avoidance curve. This gives:

$$R(\Omega_1)^2=Gz=(V_1)^2/R$$

where $\Omega_1$ (omega) is the acceleration of the aircraft 1, and $V_1$ is its velocity.

An additional approximation is then made, following on from this first calculation, saying that since:

$$(\Omega_1)=(V_1)/R$$

a conic section curve 24 is obtained such that:

$$R=(V_1)^2/Gz=(V_1)^2/\text{value of 27(collective pitch margin)}.$$

Observe that if R is infinite, then the margin 27 is non-existent, i.e. zero.

As mentioned above, in order to the avoid false warnings that are produced in aircraft by present TAWSs, in particular during tactical flight, it is useful for the distance that defines the danger zone to be as short as possible, while still maintaining maximum safety. This requires additional information. The mechanical power P(Vz) needed to enable the aircraft 1 to produce the upward force Fz is equal to the sum of the forward power (along the direction X) plus the climbing capacity, written:

$$P(Vz)=P(Vx)+(Fn\cdot Vz/2)$$

where Fn is the normal force equal to the product of its mass multiplied by gravity, i.e. Fn=Mg.

Furthermore, for selecting between pitch and power, it is possible to start from the following equation;

$$W=A+B[(\text{Col.P})-(\text{Col.P}_0)]^2\cdot[NR/NR_0]$$

where:

$NR_0$ is the speed of rotation of the rotor 2 at time $T_0$, and NR is its speed on obtaining the intended force Fz;

$(\text{Col.P}_0)$ is the collective pitch of the rotor 2 at time $T_0$;

(Col.P) is the collective pitch of the rotor 2 at the time the intended force Fz is obtained; and A, B, and C are constants that depend on the forward speed Vx of the aircraft 1.

To a first approximation, it can be said that the collective pitch $(\text{Col.P}_0)$ initially applied corresponds to developing the power required P(Vx) for forward flight, and thus that the power margin will be represented by a rate of climb equal to:

$$(\text{Fn}\cdot\text{Vz})/2$$

From the formula for the power P(Vz), the power margin is associated with the collective pitch margin $$[\text{Col.P})-(\text{Col.P}_0)]$$

in the form of proportionality with the square of the collective pitch margin. In the invention, this collective pitch margin is provided by the maneuverability indicator system 13.

Observe that if only percentage values (%) are available for the collective pitch margin, e.g. at the output from an FLI, and that if values are desired in the form of an angle value or as a value of some other physical unit, it is possible to associate power with torque margin using the following equation:

$$W=K(NR)\cdot(M_0)$$

where $(M_0)$ is the torque at instant $(T_0)$.

In one implementation, the system 13 includes a logic connection with a redundant full authority digital engine 44 control (FADEC) of the aircraft 1, which FADEC delivers a value for the available torque margin after transforming the available margin (temperature 32 or pressure 33, for example) into an instantaneous torque value using the mathematical model for said engine 44.

In such an embodiment, engines 44 are controlled and regulated by the control and regulation device that includes the FADEC, serving in particular to determine the setting for the fuel feed as a function firstly of a regulation loop including a primary loop based on maintaining the speed of rotation of the rotor 2 of the rotorcraft 1, and secondly on a secondary loop based on a setpoint value for the piloting parameter.

A FADEC also receives signals relating firstly to monitoring parameters of the engine 44 under its control, and secondly to monitoring parameters relating to important members of the rotorcraft 1 such as the speed of rotation of the main lift and advance rotor 2, for example. Thus, the FADEC forms a portion of or constitutes the maneuverability indicator system 13 so as to participate in providing the device 10 with the parameters and data it needs. In particular, the FADEC is incorporated in the computer 14 and thus in the on-board unit 9.

Consequently, the system 13 then forwards the values of the surveillance parameters to a control and regulation display arranged in the cockpit of the rotorcraft 1, via a digital connection. With reference to document FR 2 749 545, this display may include a first limitation instrument that identifies and displays a limiting parameter, i.e. the surveillance parameter that is closest to its limit It should be observed that the FADEC may optionally determine this limiting parameter, with the first limitation parameter then serving merely as a display.

Finally, the FADEC is capable of triggering various warnings in the event of incidents occurring, e.g. a minor or complete breakdown of the fuel regulation for the engine 44. In addition, the FADEC sends information to the display system via a digital connection when a surveillance parameter of the turbine engine exceeds a predetermined limit set by the engine manufacturer.

Furthermore, it is known that any increase in pitch gives rise to a vertical force on the rotor 2 that corresponds instantaneously to an acceleration along the Z direction, in application of the following formula:

$$Gz=K\cdot(\Delta\text{pitch})$$

where (Δpitch) is said pitch variation.

Under such circumstances, if the maximum pitch margin as calculated by the system 13, e.g. an FLI, is used, the following is obtained:

$$Gz=K''\cdot(\Delta S)$$

where (ΔS) is the pitch margin as delivered.

This makes it possible to identify three distinct successive and adjoining stages within an approximation to the avoidance trajectory when calculating the final trajectory TA in accordance with the invention, namely:

- a stage equal to the proximal segment 25, corresponding to level flight;
- over the conic section curve, a stage of gaining altitude with acceleration substantially of the same order as the value of Gz; and
- a pseudo-rectilinear stage with substantially constant speed Vs, during which the aircraft makes use of the maximum available engine power.

This approximation is a better representation of the genuine avoidance capacity of the aircraft 1. Since use is made of the margin delivered by the system 13, this approximation represents instantaneous reality by including all of the mass and environment parameters, together with the aging of the engine 44. In addition, if the aircraft 1 has a large amount of margin, this can make it possible to avoid a terrain warning, e.g. during tactical flight. In contrast, if the aircraft 1 is already power limited at instant $T_0$, then terrain analysis is automatically performed over a distance 22 that extends further in front of the aircraft 1.

Switching from a "short" distance 22 selected when a large amount of power is available to a longer distance 22 for the aircraft 1 when the available power presents a value below a predetermined threshold, and vice versa, is performed in real time in implementations of the invention. This constitutes a step of the method of the invention in this implementation.

In practice, with the invention, this step of switching the anticipation distance 22 is performed as a function of the map 17 within which a search is made for interactions with obstacles 18 in two calculation sectors within a maximum value for the anticipation distance, and with a large application margin for a calculation. During a first stage, consideration is given to a trajectory TA with the margin:

$$(\Delta S)=K''(Gz)$$

The available pitch is evaluated at the join between the proximal segment 25 and the conic section curve 24. The movement of the aircraft is put into equations:

- in the X direction, the movement Mx is: (Vx) times the predicted duration (Dx) that will elapse between To and the time the join is made between the proximal segment 25 and the conic section curve 24, i.e.:

$$(Mx)=(Vx)\cdot(Dx)$$

- in the Z direction, the movement (Mz) is: ½(Gz) times the square of the duration predicted to elapse between To and the time to joining the proximal segment 25 and the conic section curve 24, i.e.:

$$(Mz)=(\tfrac{1}{2})\cdot(Gz)\cdot(Dx)^2$$

Thus, movement in the Z direction can be said to be equal to: ½(Gz) times ($1/Vx^2$) multiplied by the value obtained for the X direction movement, i.e.:

$$(Mz)=(\tfrac{1}{2})\cdot(1/Vx^2)\cdot[1/(K''\cdot Mx^2)]\cdot(\Delta S)$$

This equation defines a sector of a conic section curve, here a parabola, of characteristic that is associated with the margin expressed in collective pitch terms. It can be deduced therefrom that at the end of a duration (T), the aircraft 1 will have reached a rate of climb (Vz) such that:

$$(Vz)=(Gz)\cdot(T)$$

i.e.:

$$(T)=(Vz)/(Gz)=[(K'')\cdot(\Delta S)]\cdot(Vz)$$

Thus, at this time (T), it is considered that a secondary stage has been reached, with the power available during this secondary stage being small or non-existent. As a result the speed (Vz) is in equilibrium, which corresponds to climbing at a constant rate as mentioned above.

With reference to the preceding equations, it is possible to write:

$$(K)\cdot(NR)\cdot(M_T)=[(Mg)\cdot(Vz)]$$

where ($M_T$) is the torque used at instant (T).

Knowing that the system 13 is capable of providing the available torque margin written ($\Delta M_T$), it is possible to obtain:

$$(Vz)=[(K\cdot NR)\cdot(\Delta M_T)]\cdot 2/(Mg)=K(\Delta M_T)$$

and to use this data for the stabilized climb sector.

In other words, a conic section curve is traced, here a parabola, during the first stage until time T, at which:

$$T=[(K'')/(\Delta S)]=[(K_T)\cdot(\Delta S/\Delta M_T)]$$

such that:

$$(K_T)=[(K'')/2\cdot(Mg)]\cdot(K)\cdot(NR)$$

To summarize, up to time T, a stage of the first sector is obtained that is a conic section curve, here a parabola, with:

$$(Mx)=(Vx)\cdot(Dx)$$

$$(Mz)=(K')\cdot(\Delta S)\cdot(Dx)^2$$

For the stage following the second sector, climbing takes place at the following rate:

$$(Vz)=(K'')\cdot(\Delta M_T)$$

i.e.:

$$(Mx)=[(Vx)\cdot(Dx)]$$

and $$(Mz)=[(K')\cdot(\Delta S\cdot T)]^2+[(K'')\cdot\Delta M_T\cdot(T_0-T)]^2$$

An additional improvement option is provided in an embodiment of the invention. To facilitate calculation concerning interaction with the terrain 16 on the basis of the map 17, it is possible to make use of a protection zone in the form of a linear torsor zone. Such a linear torsor zone rests on a parallel to the longitudinal direction and to the predicted trajectory 20, but defines a line that is broken rather than the curvilinear trace obtained with the preceding calculations. Starting from an initial time $T_0$, a search is made for the point of intersection P between said parallel to the longitudinal direction and to the predicted trajectory 20, and a tangent 43 to said curvilinear trace. This is shown diagrammatically in FIG. 3.

This point P possesses a position ($x_P$; $z_P$) such that:

$$z_P=0$$

whence $$T_1=T_0-[(K'\cdot\Delta S\cdot T_0)]^2/[(K'')\cdot\Delta M_T)]$$

which gives:

$$x_P=(Vx)\cdot T_1$$

In other words, on a line parallel to the longitudinal direction and to the predicted trajectory 20, the distance from the origin to $x_P$ is the margin in the X direction. The formula:

$$T_1=T_0-[(K'\cdot\Delta S\cdot T_0)]^2/[(K'')\cdot\Delta M_T]$$

makes use of the ratio between the margin output by the system 13 and the torque margin of the engine 44, and selecting the linear torsor zone instead of the initially calculated curvilinear trace continues to be fully related to the instantaneous maneuvering margins of the aircraft 1. As a result, such a rectilinear torsor zone reduces the amount of calculation required in a manner that is meaningful and coherent. This formula can easily be reduced either to terms of the margin from the system 13, or to terms of the torque margin, depending on the type of system 13 used depending on the models of aircraft 1 that have recourse to such a system 13.

As described above, the invention gives a pilot reaction time duration, e.g. determined as a function of the type of flight in progress (e.g. military or civilian, cruising or high-attention flight). This gives rise to defining a proximal segment near the rotorcraft 1 at a distance from the danger zone that is not exclusively proportional to speed. Furthermore, the direction (pull-up/nose-down) of the speed vector of the rotorcraft 1, and the rotorcraft resources available at a given instant are incorporated in the calculations of the invention for defining the danger zone.

For this purpose, one proposed solution consists in coupling the TAWS and the FLI of the rotorcraft 1 from a logical point of view. The FLI represents the resources of the rotorcraft 1 that are available at a given instant, in particular in terms of power, with this being in the form of collective pitch. As a result, it is possible at a given instant to deduce the vertical acceleration, the mass, and the direction of the velocity vector of the rotorcraft 1. In particular, the FLI involved may correspond to the teaching of document FR 2 756 256, which describes a power margin indicator where a power margin expressed in particular as a collective pitch value is generated on the basis of piloting parameters and values for limitations on the use of the engine 44.

On the basis of these deductions from the FLI and/or the FADEC, the adaptive TAWS calculates a shortened danger zone, defined by a curve in the form of a conic section, while still maintaining maximum safety.

One approach would make provision for:

producing a limit value (short pilot reaction time, e.g. of the order of less than one second for high-attention flight, to less than two seconds for cruising flight, characterized by a segment that substantially proportional to the speed of the aircraft) for uniform transfer to a duration, i.e. a time, that is as limited as possible (e.g. as a function of the type of flight, the stage of flight, history data, and data concerning the personal competence of the pilot under such circumstances); and deducing therefrom a so-called pseudo-conic section curve (i.e. a curve which projected onto a plane substantially parallel to a longitudinal direction of the aircraft and intersecting its trajectory at its origin, described at least one segment of a conic section curve, such as a parabola) for avoidance purposes, which segment is associated in particular with the maneuverability of the rotary wing aircraft 1, in real time.

The invention is nevertheless not limited to the implementations described. On the contrary, it covers any equivalents of the characteristics described.

What is claimed is:

1. A method of generating a terrain avoidance warning for a rotary wing aircraft comprising:

generating an avoidance trajectory including a proximal segment representative of a transfer time and an avoidance curve including at least one distal segment of a conic section curve following on from the proximal segment, wherein the proximal segment extends in continuation from a predicted trajectory over a distance representing an applicable reaction time, the applicable reaction time being minimized as a function of a route sheet for the aircraft; and wherein the generating includes calculating the at least one distal segment as a function of an instantaneous maneuverability of the aircraft.

2. The method as recited in claim 1, wherein the proximal segment is rectilinear.

3. The method as recited in claim 1, wherein the applicable reaction time is minimized as a function of the route sheet and of a parameter representative of a model of the aircraft.

4. The method as recited in claim 1, wherein an applicable reaction time is minimized as a function of the route sheet and divided by at least one limiting ratio representing a flight parameter of the aircraft.

5. The method as recited in claim 1, wherein the conic section curve includes a section of one of a parabola, an ellipse and a hyperbola.

6. The method as recited in claim 1, wherein the conic section curve is calculated in real time as a function of up-to-date data produced by at least one of an avionics unit, a maneuverability indicator system and a flight computer.

7. The method as recited in claim 6, wherein up-to-date data include at least one of a possible vertical acceleration value and an instantaneous mass value for the rotary wing aircraft.

8. A terrain warning device disposed at least in part on board an aircraft comprising:

an avionics unit having a flight computer configured to execute a code, wherein the code is configured to generate an avoidance trajectory including a proximal segment representative of a transfer time and an avoidance curve including at least one distal segment of a conic section curve following on from the proximal segment, the proximal segment extending in continuation from a predicted trajectory over a distance representing an applicable reaction time, the applicable reaction time being minimized as a function of a route sheet for the aircraft; and wherein the at least one distal segment is calculated as a function of an instantaneous maneuverability of the aircraft.

9. The terrain warning device as recited in claim 8, wherein the terrain warning device is logically coupled to a maneuverability indicator system.

10. A rotary wing aircraft comprising:

a terrain warning device disposed at least in part on board the aircraft including an avionics unit having a flight computer configured to execute a code, wherein the code is configured to generate an avoidance trajectory including a proximal segment representative of a transfer time and an avoidance curve including at least one distal segment of a conic section curve following on from the proximal segment, the proximal segment extending in continuation from a predicted trajectory over a distance representing an applicable reaction time, the applicable reaction time being minimized as a function of a route sheet for the aircraft; and wherein the at least one distal segment is calculated as a function of an instantaneous maneuverability of the aircraft; and a sound alarm logically coupled to the terrain warning device and configured to be triggered selectively by the terrain warning device.

11. The rotary wing aircraft as recited in claim 10, wherein the rotary wing aircraft is at least one of a helicopter, a convertible rotary wing aircraft, and a drone.

* * * * *